US007195464B2

(12) United States Patent
Lanfredi

(10) Patent No.: US 7,195,464 B2
(45) Date of Patent: Mar. 27, 2007

(54) HYDRAULIC AXIAL PISTON PUMP

(75) Inventor: Giancarlo Lanfredi, Suzzara (IT)

(73) Assignee: Lavorwash S.p.A., Suzzara (IT)

( * ) Notice: Subject to any disclaimer, the term of this patent is extended or adjusted under 35 U.S.C. 154(b) by 466 days.

(21) Appl. No.: 10/880,561

(22) Filed: Jul. 1, 2004

(65) Prior Publication Data

US 2005/0008506 A1 Jan. 13, 2005

(30) Foreign Application Priority Data

Jul. 10, 2003 (IT) ..... PD20030053 U

(51) Int. Cl.
*F04B 17/00* (2006.01)
*F04B 39/00* (2006.01)
*F04B 5/00* (2006.01)
*F16K 25/00* (2006.01)

(52) U.S. Cl. ..... 417/269; 417/415; 417/454; 417/176; 137/454.4

(58) Field of Classification Search ..... 417/269, 417/415, 307, 440, 176, 569, 454; 137/454.2, 137/454.4
See application file for complete search history.

(56) References Cited

U.S. PATENT DOCUMENTS 4,589,825 A 5/1986 Schmidt et al.
4,810,169 A 3/1989 Kraenzle et al.
4,851,724 A 7/1989 Polk et al.
5,086,975 A * 2/1992 Paige ..... 239/124
6,092,998 A * 7/2000 Dexter et al. ..... 417/360
6,450,777 B2 * 9/2002 Lynn et al. ..... 417/269

FOREIGN PATENT DOCUMENTS

EP 0 793 017 9/1997
WO WO 97/14171 5/1996

* cited by examiner

*Primary Examiner*—Ehud Gartenberg
*Assistant Examiner*—Jessica Frantz
(74) *Attorney, Agent, or Firm*—Modiano & Associati; Albert Josif; Daniel J. O'Byrne

(57) ABSTRACT

A hydraulic axial piston pump comprising a cylinder block closed at sides by a head and by a containment casing for piston actuating a plate, an electric motor coupled to the plate, reversible locking means for a bypass valve inserted in a seat of the body and kinematically connected to a microswitch connected to the electric motor, the reversible locking means comprising a retention element insertable transversely to the seat in a receptacle formed in the body without structure discontinuity, the bypass valve head being integrated in a shell external to the body and enclosing the microswitch and the kinematic system.

13 Claims, 6 Drawing Sheets

HYDRAULIC AXIAL PISTON PUMP

The present invention relates to a hydraulic axial piston pump.

BACKGROUND OF THE INVENTION

Axial piston pumps are currently known and widespread and are used for example in the field of high-pressure washers; they comprise an outer casing, which is constituted by a central pump body that is closed on one side by a corresponding head and is coupled, on the opposite side, to an electric motor that is provided with a cooling air duct.

Generally, together with the ordinary delivery and intake valves there is a high-pressure bypass valve (functionally connected to the delivery and the intake of the pump), which allows to recirculate the water inside the pump when the delivery is blocked, for example by releasing the button for blocking the nozzle of the lance-gun of the high-pressure washer to which the pump is applied.

Such high-pressure bypass valve is screwed into a complementarily threaded seat formed in the central pump body.

To prevent the motor from idling without pumping during water recirculation, a switching device is screwed onto the head of the high-pressure bypass valve and, by means of a transmission that is kinematically connected to the stem of the bypass valve, it operates a microswitch that is connected to the electric motor by means of electrical cables.

During the assembly of the pump, part of the time is dedicated to screwing the high-pressure bypass valve into the corresponding seat, part is dedicated to screwing the switching device onto the bypass valve, and part is dedicated to connecting the electrical cables to the switching device.

These operations occur also during disassembly, which is required for example during pump maintenance.

Generally, electronic components for controlling and managing the operation of the electric motor are associated therewith (and the electric cables that arrive from the microswitch are generally connected to said components). These components are fixed, generally in a rather inaccurate manner, on abutments formed on the outside of the air duct of the motor, and are scarcely protected against dirt, moisture, any accidental impacts during maintenance, et cetera.

The axial piston pumps thus described often have a device for injecting detergent into the water stream that flows from the delivery to the nozzle of the dispensing gun-lance.

These detergent injection devices are generally constituted by a Venturi tube, which is screwed into a complementarily threaded portion of the pump delivery tube, so as to produce a partial vacuum toward the nozzle of the dispensing gun-lance.

At the inlet of the Venturi tube (on the partial vacuum side), on the delivery tube there is a perpendicular connector onto which a check valve is screwed; a tube is screwed onto said valve and leads to a tank of detergent. The detergent injection device operates thanks to the partial vacuum produced by the Venturi tube, which allows to open the check valve and draw the detergent.

In this case also, as in the case of the bypass valve, it is not straightforward to provide correct assembly of the various components; moreover, it is complicated and expensive to provide the various threads on the delivery tube.

A similar problem occurs also for the delivery valves of the pump; each delivery valve is in fact generally screwed into a corresponding complementarily threaded cavity formed in the head of the pump.

SUMMARY OF THE INVENTION

The aim of the present invention is to provide a hydraulic axial piston pump that solves the drawbacks noted in conventional pumps.

Within this aim, an object of the present invention is to provide a hydraulic axial piston pump that allows easier assembly of the various components of said pump.

Another object of the present invention is to provide a hydraulic axial piston pump that facilitates disassembly of the various components of the pump.

Another object of the present invention is to provide a hydraulic axial piston pump that allows to reduce the processes required to manufacture the various components of the pump.

A further object of the present invention is to provide a hydraulic axial piston pump that is particularly compact and sturdy.

A still further object of the present invention is to provide a hydraulic axial piston pump that can be manufactured with known systems and technologies.

This aim and these and other objects that will become better apparent hereinafter are achieved by a hydraulic axial piston pump, comprising a cylinder body that is closed on one side by a corresponding head and is flanged on the opposite side with a containment casing for a plate for actuating the pistons of the pump, said casing being coupled to an electric motor that is functionally coupled to said plate, said cylinder body being associated with reversible locking means for a high-pressure bypass valve that is kinematically connected to a microswitch that is electrically connected to said electric motor, said bypass valve being inserted in a corresponding seat of said cylinder body and being functionally connected to the delivery and the intake of said pump, said pump being characterized in that said reversible locking means comprise a retention element that can be inserted transversely with respect to said seat in a corresponding receptacle formed in said cylinder body and without discontinuity on the structure of said bypass valve, the head of said bypass valve, which is external with respect to said seat, being integrated in a shell that encloses said microswitch and the corresponding kinematic system for connection to said bypass valve, the cables for electrical connection to said electric motor further exiting from the inside of said shell.

BRIEF DESCRIPTION OF THE DRAWINGS

Further characteristics and advantages of the present invention will become better apparent from the following detailed description of a preferred but not exclusive embodiment thereof, illustrated by way of nonlimiting example in the accompanying drawings, wherein.

DESCRIPTION OF THE PREFERRED EMBODIMENTS

Figure 1:
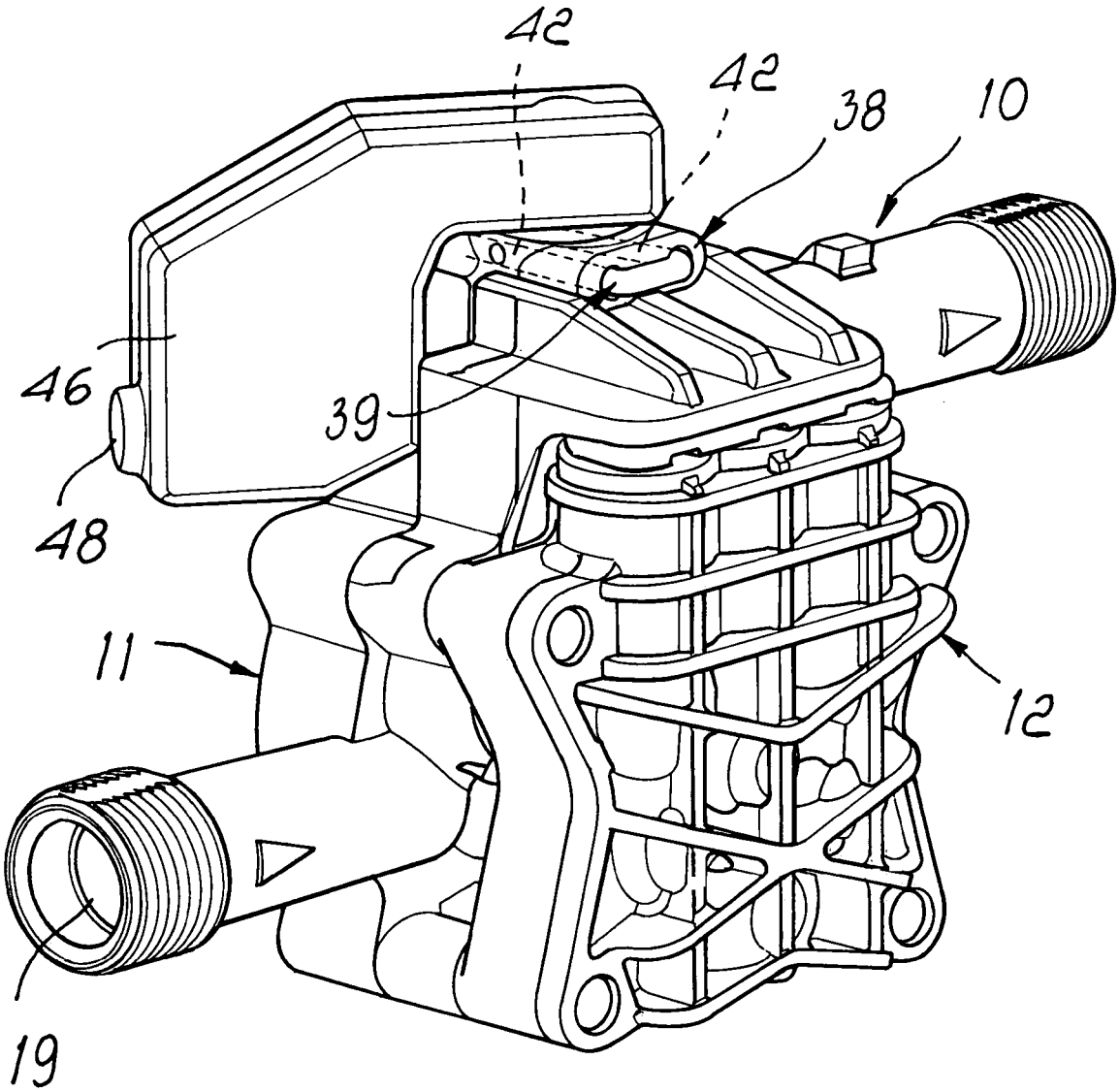
FIG. 1 is a perspective view of the cylinder body and of the corresponding head of a pump according to the invention.
Figure 2:
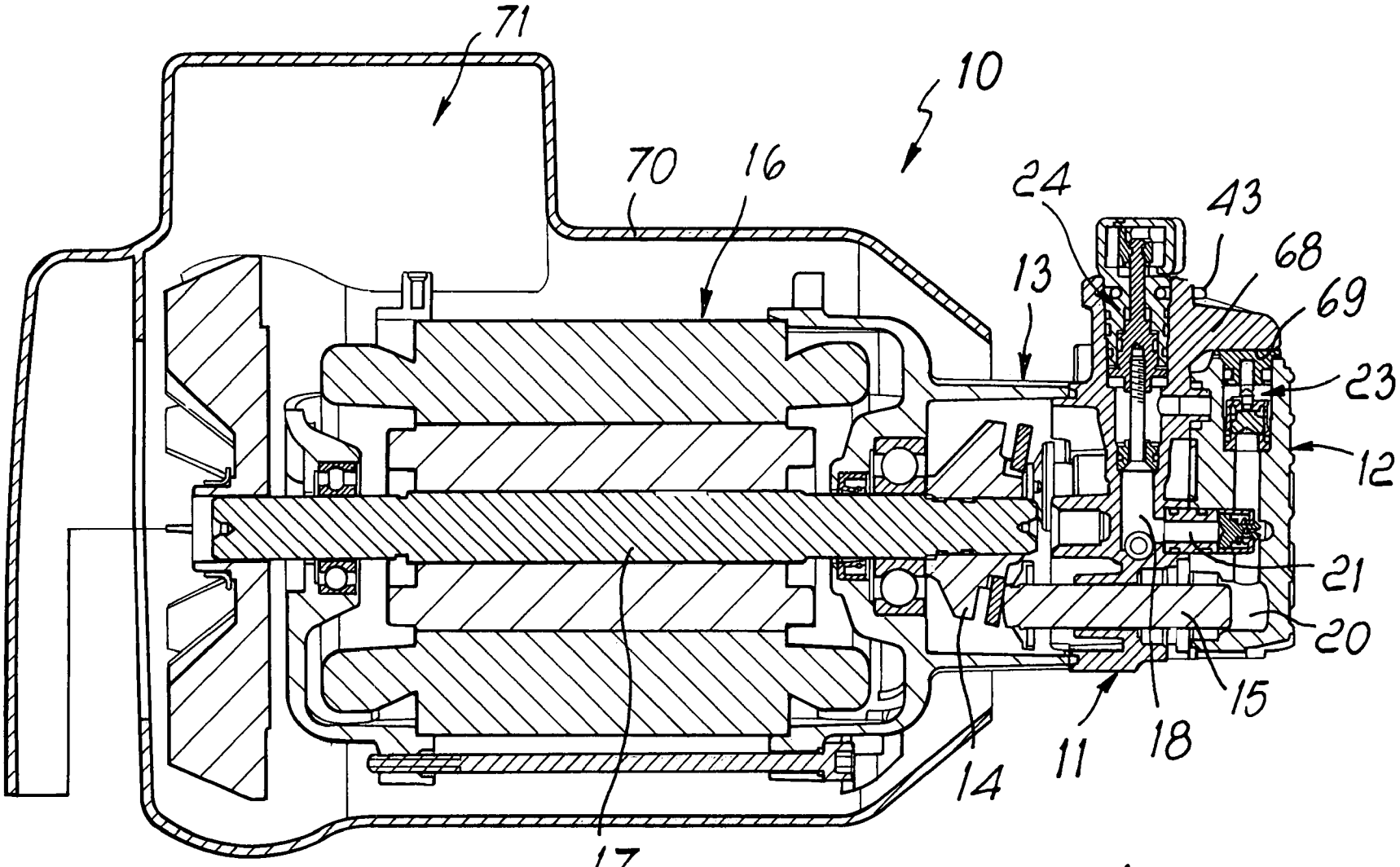
FIG. 2 is a sectional side view of the pump according to the invention.

With reference to the figures, a hydraulic axial piston pump according to the invention is generally designated by the reference numeral 10.

The pump 10 comprises a cylinder body or block 11, which is closed on one side by a corresponding head 12 and is flanged, on the opposite side, to a containment casing 13 for a plate 14 for actuating the pistons 15 of the pump 10.

The casing 13 is rigidly coupled to an electric motor 16, the output shaft 17 of which is keyed directly to the plate 14.

The cylinder body 11 comprises an intake chamber 18, which is connected directly to an intake connecting tube 19; the intake chamber 18 is further functionally connected to cylinder chambers 20 by way of corresponding intake valves 21.

The cylinder chambers 20 are functionally connected to a delivery connecting tube 22 by means of corresponding delivery valves 23.

The delivery connecting tube 22 is functionally connected to the intake chamber 18 by way of a high-pressure bypass valve 24.

The high-pressure bypass valve 24 is inserted in a corresponding seat 25 formed at the head of the cylinder body 11.

Figure 3:
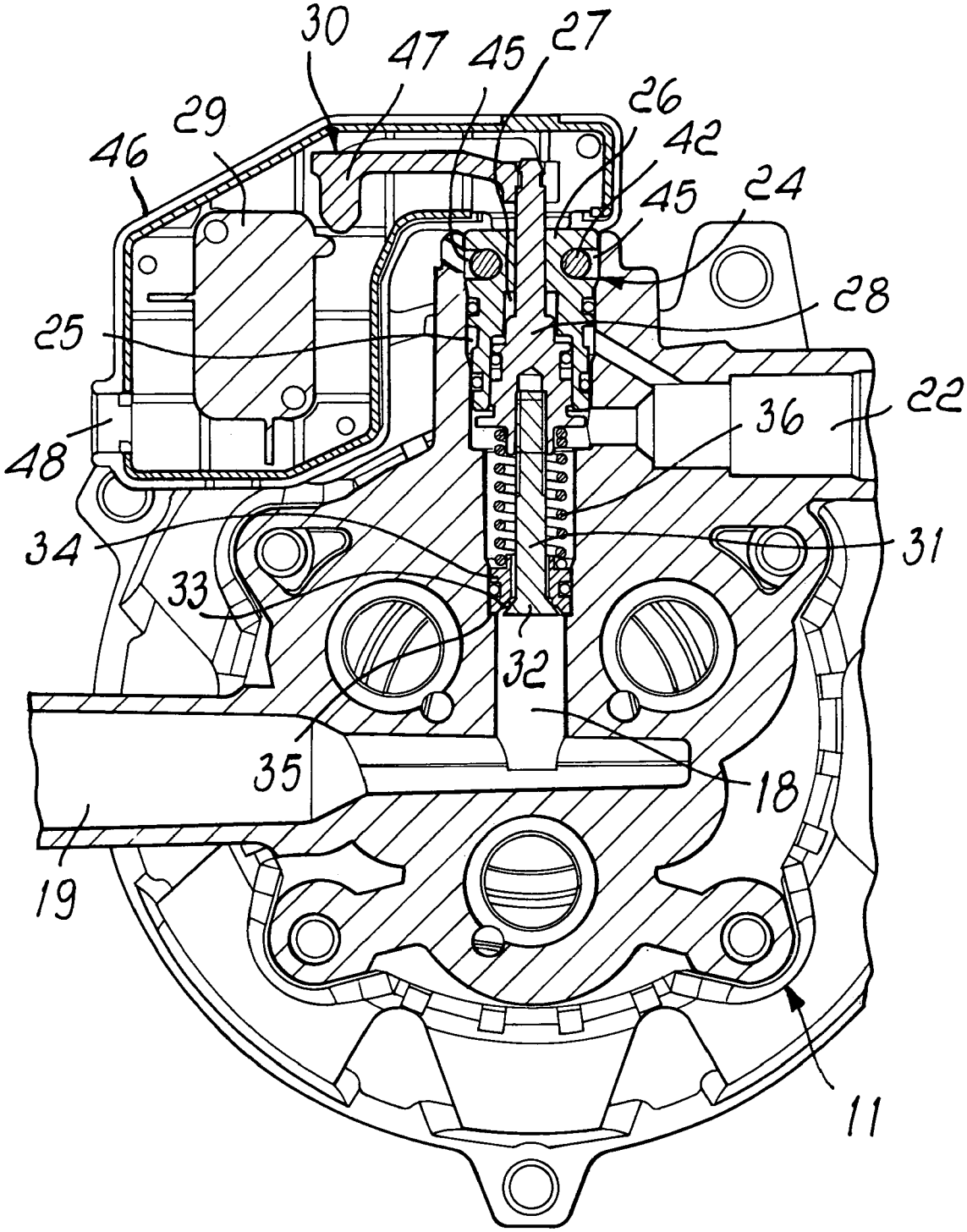
FIG. 3 is a sectional front view of the cylinder body and of the corresponding head of a pump according to the invention.
Figure 4:
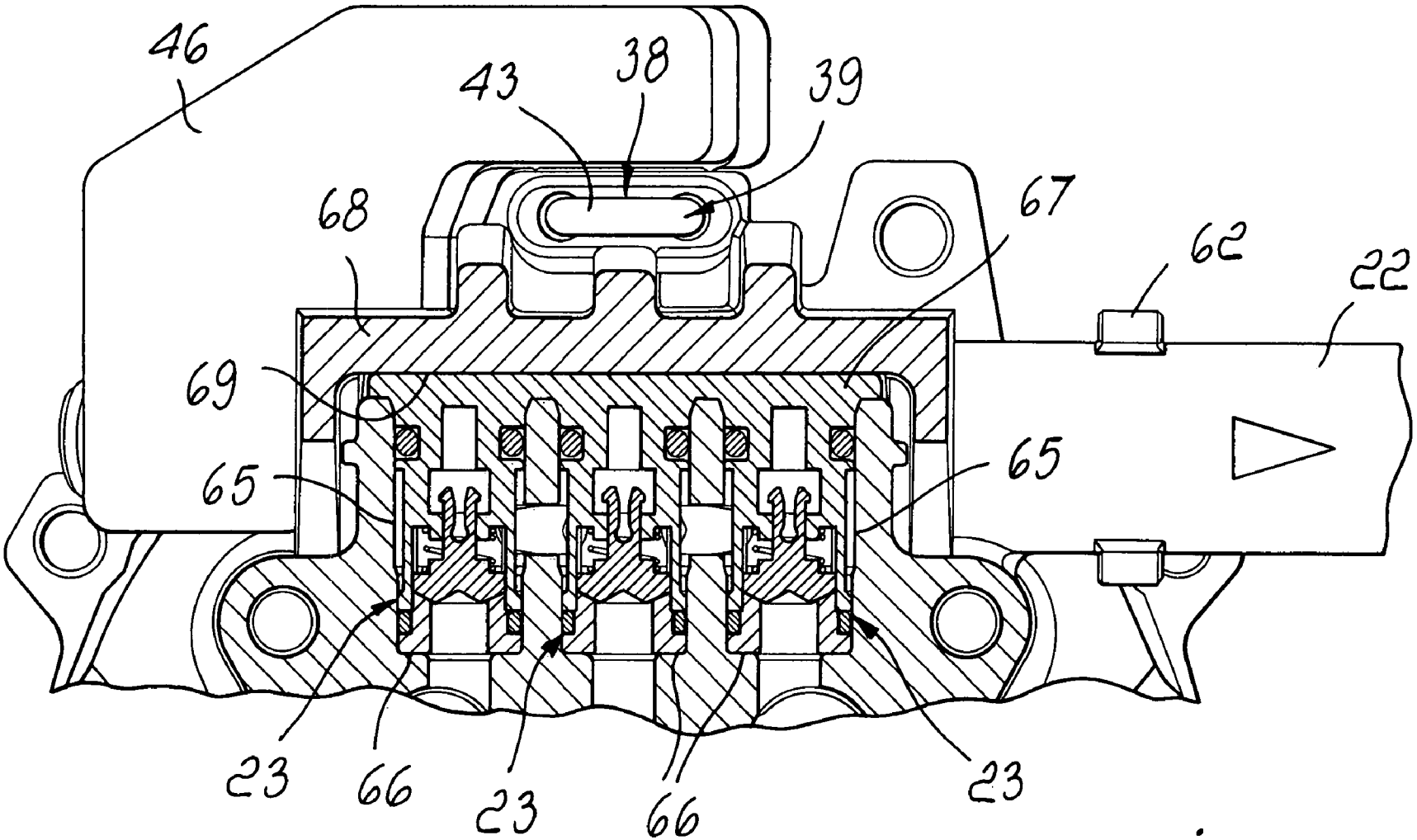
FIG. 4 is a sectional front view of a detail of the head and of the cylinder body of the pump according to the invention.
Figure 5:
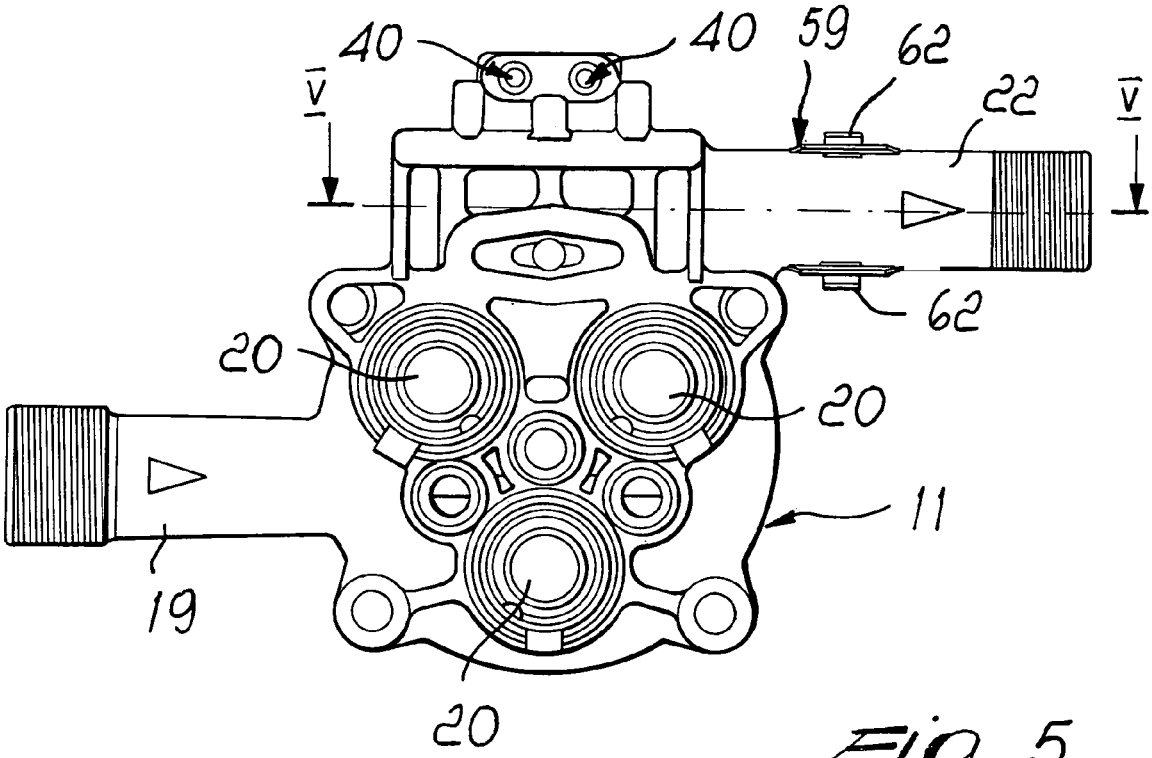
FIG. 5 is a front view (taken from the side of the head) of the cylinder body of the pump according to the invention.

As clearly shown in FIG. 3, the high-pressure bypass valve 24 is constituted by a valve body 26, in which there is a through cavity 27 in the direction of the actuation of the valve; a stem 28 for actuating the bypass valve 24 is arranged slidingly within the cavity 27.

The stem 28 protrudes partially from the valve body 26 for connection to a microswitch 29 by means of a corresponding kinematic system 30, described hereinafter.

A flow control element 31 is coupled coaxially, by means of a threaded coupling, on the stem 28, on the opposite side with respect to the kinematic system 30. The flow control element 31 is substantially pin-shaped and has a sealing head 32 that mates with a complementary sealing seat 33 formed on a contrast element 34 through which the flow control element 31 passes.

The contrast element 34 is cylindrical and abuts, with the peripheral rim of one of its end faces, against a corresponding sealing shoulder 35 formed on the cylinder body 11. An elastic element 36, such as for example a helical spring, is arranged between the end face that lies opposite with respect to said peripheral rim in abutment and the stem 28. In this manner, when the bypass valve 24 is to be assembled with the cylinder body 11, the contrast element 34 is coupled between the sealing head 32 and the elastic element 36, becoming monolithic with said bypass valve.

Containment slots for corresponding sealing gaskets, not designated by reference numerals in the figures for the sake of clarity in illustration, are formed in the valve body 26 and in the stem 28 and on the elastic element 36.

The cylinder body 11 is associated with means 38 for reversible locking of the high-pressure bypass valve 24.

The reversible locking means 38 comprise a retention element 39, which can be inserted transversely with respect to the seat 25 in a corresponding receptacle 40 formed in the cylinder body 11 and without discontinuity in the structure of the bypass valve 24, particularly in the valve body 26.

Figure 8:
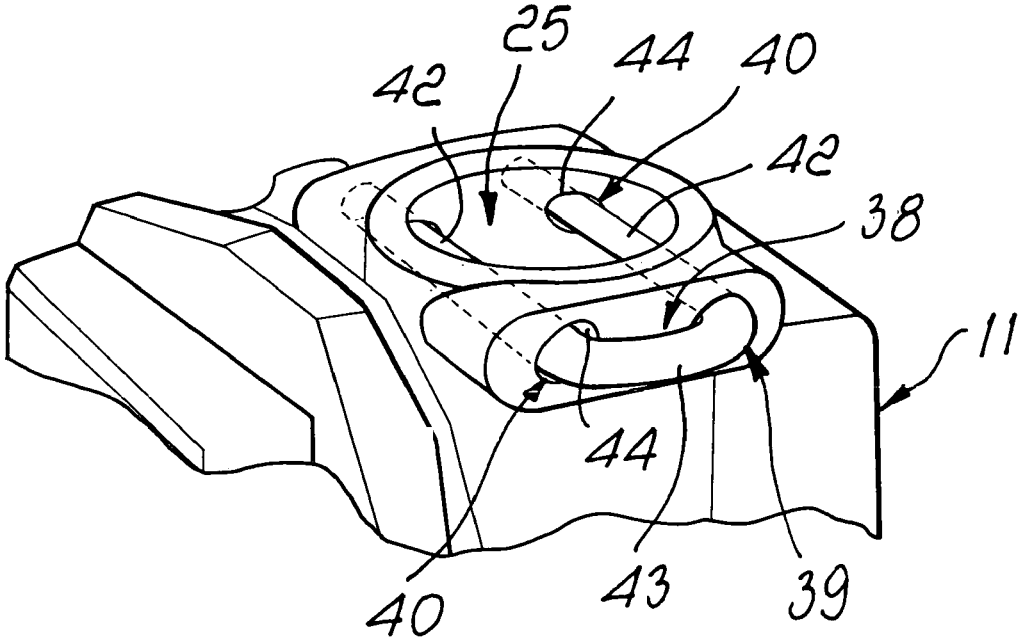
FIG. 8 is another perspective view of a detail of the cylinder body of the pump according to the invention.

The retention element 39 (see for example FIG. 8) is substantially constituted by a fork, which is substantially U-shaped, has a circular transverse cross-section, and is formed by two lateral portions 42 that are connected by a connecting portion 43.

The receptacle 40 is formed by two parallel channels 44, which are formed transversely through the cylinder body 11 and the seat 25 for accommodating the bypass valve at the opening of the seat 25.

The receptacle 40 is also further formed through the valve body 26, particularly in the space formed by an annular slot 45 formed coaxially in the valve body 26, in an arrangement that is substantially aligned with the parallel channels 44 when the bypass valve 24 is inserted in the seat 25.

The portions 42 of the fork 41 are therefore inserted respectively in the parallel channels 44 and the annular slot 45, while the connecting portion 43 remains outside the cylinder body 11.

The portions 42 of the fork 41 can mutually converge (or optionally diverge) so as to ensure, by being elastically deformable, higher grip on the cylinder body 11 and on the valve body 26.

The head of the bypass valve 24 is integrated in a shell 46, which encloses the microswitch 29 and the corresponding kinematic system 30 for connection to the stem 31.

The kinematic system 30 is constituted by a transmission element 47, which is rigidly coupled to the part of the stem 31 that protrudes from the valve body 26.

The transmission element 47 moves downward and upward rigidly with the stem 31, opening or closing the microswitch 29.

Electrical cables (not shown in the figures) for connection to the electric motor 16 are associated with the microswitch 29 and exit from the shell 46 by means of an opening 48.

In practice, the shell 46, with the bypass valve 24 integrated therein, constitutes a "connector" that can be mated by insertion (for the part related to the valve 24) in the seat 25.

The fork 41 prevents the axial extraction of the bypass valve 24 (and therefore of the "connector") from the seat 25.

The operation of the bypass valve 24 is known; when the delivery is blocked, for example by operating the button for closing the nozzle of the gun-lance with which the pump can be associated, the pressure rises enormously and therefore the high-pressure bypass valve 24 opens, recirculating the water flow inside the pump. The valve opens by lowering the flow control element 31 and accordingly by lowering the stem 28, which lowers the transmission element 47 until it makes contact with the microswitch 29, thus interrupting the power supply circuit of the electric motor 16 (avoiding the overheating of the electric motor). As soon as the delivery reopens, the flow control element 31 rises and the microswitch 29 again closes the supply circuit of the motor, which can thus restart, pumping water.

Figure 6:
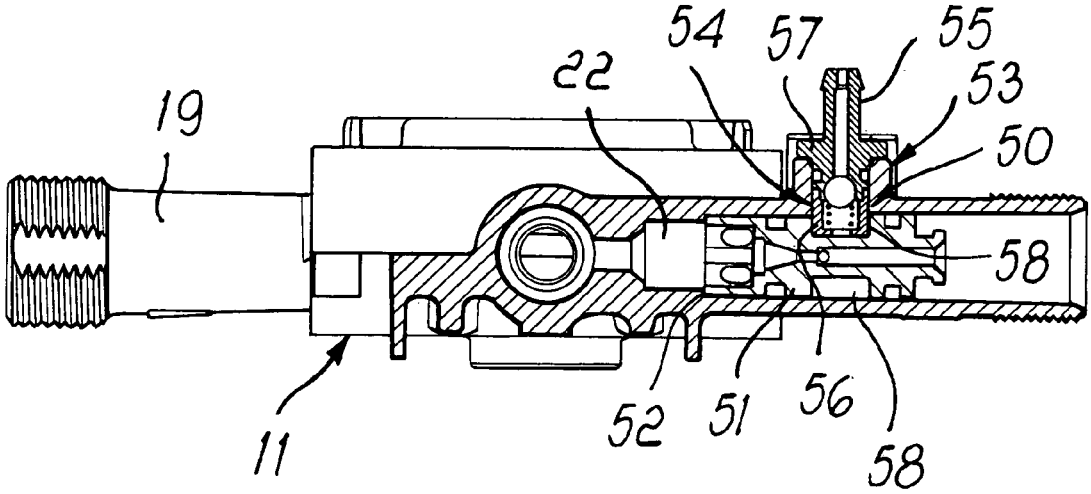
FIG. 6 is a sectional plan view of the cylinder body of the pump according to the invention, taken along the line V—V of FIG. 5.

The pump 10 further comprises a device for injecting detergent into the delivery 50, which is constituted by a Venturi tube 51 inserted in the delivery connecting tube 22, as shown in FIG. 6.

The Venturi tube 51 substantially has the same diameter as the inside of the delivery connecting tube 22, and abuts against an abutment shoulder 52.

A connecting collar 53 opens onto the delivery connecting tube 22, at the Venturi tube 51, and is substantially perpendicular to the axis of the delivery connecting tube 22.

Inside the connecting collar 53 a check valve 54 is provided, of the type with a flow control element constituted by a ball and a return spring.

The check valve 54 is composed of a nozzle 55, for connection to a tube that is functionally connected to a tank of detergent (both not shown in the figures), and of a valve body 56.

The valve body 56 is inserted in the connecting collar 53, while the nozzle 55 protrudes from said collar.

An annular abutment 57 lies laterally to the nozzle 55 and abuts against the outer edge of the redirection channel of the collar 53.

In particular, the valve body 56 protrudes into the delivery connecting tube 22 and is locked between the lateral shoulders of an annular pocket 58 formed in the body of the Venturi tube 51.

In this manner, the Venturi tube 51 is locked axially between the abutment shoulder 52 and the part that protrudes inside the delivery connecting tube 22 of the valve body 56.

Figure 7:
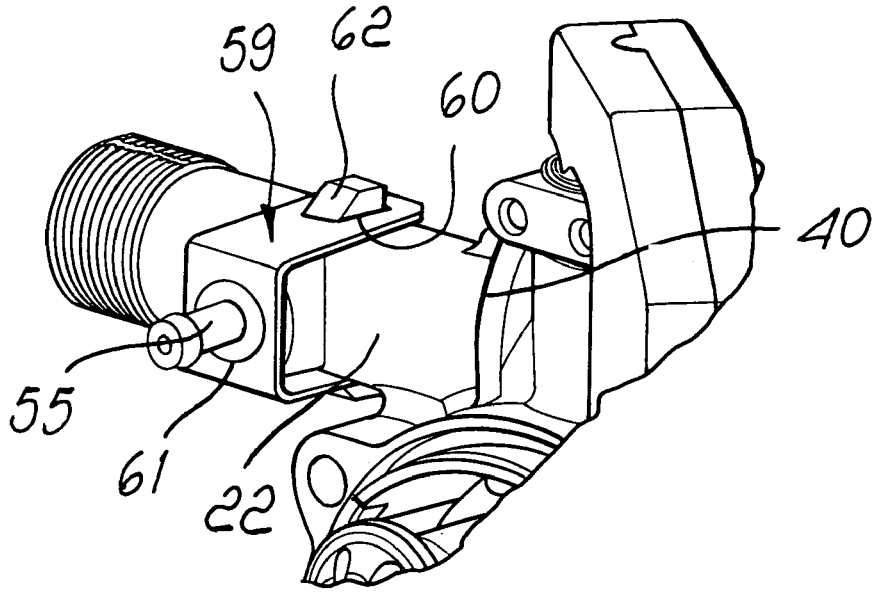
FIG. 7 is a perspective view of a detail of the cylinder body of the pump according to the invention.

As clearly shown in FIG. 7, the check valve 54 is locked in its seat formed in the connecting collar 53 by a clip 59, which prevents its axial extraction; the clip 59 is constituted by an elastically deformable lamina that is folded in a C-like shape and has two holes 60 formed in the parallel portions of the lamina and a circular hole 61, which has a larger diameter than the nozzle 55 and is formed in the portion that connects the parallel portions of the C-shaped lamina.

The holes 60 mate with complementary teeth 62, which are formed on the outside of the delivery connecting tube 22, while the connecting portion of the parallel portions of the C-shaped lamina rests on the annular abutment 57, with the nozzle 55 inserted in the circular hole 61.

Receptacles for corresponding sealing gaskets (both not shown in the figures) are formed in the check valve 54 and in the Venturi tube 51.

The operation of the detergent injection device at the delivery 50 is known; the detergent is drawn into the delivery connecting tube 22 by the partial vacuum generated by the Venturi tube 51.

As regards the delivery valves 23, each one of said valves is inserted in a respective containment slot 65 formed in the head 12 of the pump and abuts against a corresponding abutment shoulder 66. The containment slots 65 are substantially parallel to each other.

Advantageously, the delivery valves 23 are rigidly joined in a single battery: the respective heads are thus rigidly coupled to each other in a common joining head 67, which is flat and abuts against the head 12.

The head 12 is coupled laterally to the cylinder body 11 by way of threaded connections (not shown in the figures); in an upper region, on the side for the insertion of the delivery valves 23, the head 12 is delimited by a ledge 68 that is monolithic with the cylinder body 11.

The ledge 68 has a reference surface 69 that lies transversely to the containment slots 65 and is in contact with the joining head 67 of the battery of delivery valves 23, preventing said delivery valves from leaving their containment slots 65. In practice, the delivery valves 23 are locked between the abutment shoulders 66 and the ledge 68.

Receptacles for corresponding sealing gaskets (both not shown in the figures) are formed in the delivery valves 23.

With regards to the electric motor 16 (see FIG. 1), said motor comprises an air duct 70, which in turn comprises a box-like receptacle 71 for insertion of the electronic components (not shown in the figures) for controlling and managing said electric motor. The box-like receptacle 71 is substantially open toward the inside of the electric motor 16 and closed toward the outside of said motor.

In practice it has been found that the invention thus described solves the drawbacks noted in known types of axial piston pump: in particular, the present invention provides a hydraulic axial piston pump that allows easier assembly of the various components of said pump.

Thanks to the fact that the high-pressure bypass valve has been integrated in a shell that also supports the microswitch and the corresponding kinematic system for actuation and that the locking of said valve on the cylinder body has been simplified, the steps for the assembly (and disassembly) of these components have been simplified.

Further, the use of a single battery of delivery valves, which is inserted and not screwed into the corresponding containment slots, and its locking simply by coupling the head to the cylinder body, have allowed to simplify the steps for the assembly (and disassembly) of said components.

Moreover, using a Venturi tube that is inserted, not screwed on, and locked by the check valve (which in turn is no longer screwed onto the delivery connecting tube) simplifies the assembly (and disassembly) steps.

These solutions, moreover, have reduced the processes required to manufacture the various components of the pump, since the provision of threads and complementary threads has been eliminated.

Moreover, the present invention provides a hydraulic axial piston pump that is provided with an air duct of the electric motor that allows convenient containment of the electric and electronic components of the motor, which are thus particularly protected against dirt and any environmental agents that might damage them.

In practice, the materials employed, so long as they are compatible with the specific use, as well as the dimensions, may be any according to requirements and to the state of the art.

The disclosures in Italian Utility Model Application No. PD2003U000053 from which this application claims priority are incorporated herein by reference.

What is claimed is:

1. A hydraulic axial piston pump, comprising: fluid delivery and intake; a cylinder body; pistons; a corresponding head that closes at a first side said block; a containment casing that flanges at a second, opposite side of said block; a plate contained in said casing for actuating said pistons of the pump; an electric motor coupled to said casing that is functionally coupled to said plate; a microswitch electrically connected to said electric motor; a high-pressure bypass valve inserted in a corresponding seat of said cylinder body and functionally connected to the delivery and the intake of said pump; reversible locking means for locking said high-pressure bypass valve that is kinematically connected to said microswitch; a corresponding kinematic system for connection of the microswitch to said bypass valve; and cables for electrical connection to said electric motor; and wherein said reversible locking means comprises a retention element that is transversely insertable with respect to said seat of the cylinder body, in a corresponding receptacle formed in said cylinder body without structure discontinuity of said bypass valve, said bypass valve having a head that is integrated in a shell external with respect to said cylinder body and which encloses said microswitch and said kinematic system, said electrical connection cables further exiting from the inside of said shell.

2. The hydraulic pump of claim 1, wherein said retention element is constituted by a fork that is substantially U-shaped and is formed by two lateral portions connected by a connecting portion, said receptacle being constituted by two parallel channels that are formed transversely through said cylinder body and through said seat for containing said bypass valve at an opening of said seat, said receptacle further extending in a space delimited by an annular slot formed in the valve body of said bypass valve, in a configuration that is substantially aligned with said parallel channels with said bypass valve inserted in said seat, said lateral portions of the fork being insertable, respectively, in said parallel channels and in said annular slot.

3. The hydraulic pump of claim 1, wherein said bypass valve integrated in said shell comprises a flow control element, and a valve body with an actuation stem arranged slidingly therethrough, said stem protruding partially from said valve body and being rigidly coupled to said flow control element, said kinematic system arranged inside said shell being constituted by a transmission element that is rigidly coupled to a part of said stem that protrudes from said valve body, said transmission element being movable with a translational motion for opening and closing said microswitch.

4. The hydraulic pump of claim 3, said bypass valve comprising: a contrast element; said valve body being provided with a through cavity extending in a direction of actuation of said bypass valve, said actuation stem being slidingly arranged within said cavity, said flow control element being coupled coaxially, by way of threaded couplings, to said stem and being pin-shaped and having a sealing head that mates with a complementarily shaped sealing seat, said sealing seat being formed in said contrast element, through which said flow control element passes, said contrast element further abutting with a peripheral rim provided at a first end thereof against a corresponding sealing shoulder that is formed on said cylinder body; and an elastic element that is arranged between a second end of said contrast element, that lies opposite said first end with the peripheral rim, and said stem.

5. The hydraulic pump of claim 4, comprising a detergent injection device, which is locked inside the delivery of said pump and is constituted by a Venturi tube and by a check valve, said check valve being constituted by a valve body and by a nozzle for connection to a tube that is functionally connected to a detergent tank, said check valve being arranged inside a connecting collar that is formed in said pump delivery at a level of said Venturi tube, said Venturi tube being locked, at a first end thereof, by an abutment formed by an abutment shoulder formed in said delivery and, at a second opposite end thereof, by an abutment formed by said valve body, which protrudes inside said delivery.

6. The hydraulic pump of claim 5, wherein said check valve is provided with a clip and is arranged inserted in said connecting collar, locked axially by said clip, which is coupled to said pump delivery.

7. The hydraulic pump of claim 6, comprising an annular pocket for accommodating a portion of the valve body that protrudes inside said pump delivery and which is formed on said Venturi tube and acts as an abutment for locking said Venturi tube, said clip being constituted by an elastically deformable lamina that is folded in a C-shape and has two holes provided in the parallel portions of said lamina and a hole provided in a connecting portion of said parallel portions of the C-shaped lamina, said holes being mated with complementary teeth formed at an outside region of said delivery connecting tube, said portion for connecting the parallel portions of the C-shaped lamina resting on a base of said nozzle formed by an annular abutment, said nozzle being inserted in said hole.

8. The hydraulic pump of claim 1, comprising delivery valves each of which is inserted in a respective containment slot, formed in said head, and rests against a corresponding abutment shoulder that is formed in said containment slots, said head coupled to said cylinder body being delimited, on a side where said delivery valves are inserted in the respective containment slot, by a ledge that is provided monolithic with said cylinder body and has a reference surface that lies transversely to said containment slots and is in contact with a valve head of said delivery valves, said delivery valves being locked between said ledge and said abutment shoulders.

9. The hydraulic pump of claim 8, wherein respective valve heads of said delivery valves are provided with a common joining head, so as to form a single battery of delivery valves, said common joining head abutting against said head.

10. The hydraulic pump of claim 1, wherein said electric motor comprises an air duct, which is provided with a box-like receptacle for insertion of electronic components for control and management of the electric motor, said box-like receptacle being open toward an inside region of the electric motor and closed toward an outside region of said motor.

11. A hydraulic axial piston pump, comprising: a delivery tube; a detergent injection device that is locked inside said delivery tube and comprises a Venturi tube and a check valve, constituted by a valve body and by a nozzle for connection to a tube that is functionally connected to a detergent tank, said check valve being arranged inside a connecting collar, which is formed on said delivery tube at a position corresponding to that of said Venturi tube, said Venturi tube being blocked, at a first end thereof, by an abutment formed by an abutment shoulder that is formed in said delivery tube and, at a second opposite end thereof, by an abutment formed by said valve body, which protrudes inside said delivery tube.

12. The hydraulic pump of claim 11, wherein said check valve is provided with a clip and is inserted in said connecting collar locked axially by said clip that is further coupled to said delivery tube.

13. The hydraulic pump of claim 12, wherein said Venturi tube comprises an annular pocket for containing a portion of the valve body that protrudes inside said delivery tube, said annular pocket constituting a locking abutment for said Venturi tube, said clip being constituted by an elastically deformable lamina that is folded into a C-shape with two parallel portions and a connecting portion, said lamina being provided with two holes formed in the parallel portions thereof and a hole formed in the connecting portion of said parallel portions, said delivery tube comprising teeth formed complementarily to said holes on an outside region of said delivery tube, said holes being coupled to said complementary teeth, said portion for connecting the parallel portions of the C-shaped lamina resting on a base of said nozzle that is formed by an annular abutment, said nozzle being inserted in said hole.

* * * * *